US005255169A

United States Patent [19]

Koch

[11] Patent Number: 5,255,169

[45] Date of Patent: Oct. 19, 1993

[54] LUMINARY

[76] Inventor: Dustin Koch, 1019 Franklin Pl., Rockford, Ill. 61103

[21] Appl. No.: 8,631

[22] Filed: Jan. 25, 1993

[51] Int. Cl.[5] ..... F21L 19/00

[52] U.S. Cl. ..... 362/162; 362/352; 431/291

[58] Field of Search ..... 362/162, 161, 352, 312, 362/316, 314; 431/289, 297, 291

[56] References Cited

U.S. PATENT DOCUMENTS 5,034,868 7/1991 Stelfox et al. ..... 362/352

FOREIGN PATENT DOCUMENTS 229864 1/1911 Fed. Rep. of Germany ..... 362/162
462047 7/1928 Fed. Rep. of Germany ..... 362/352
2634 of 1887 United Kingdom ..... 362/162

OTHER PUBLICATIONS

R. C. Company Broshure, "Electric Luminarias", Nov. 1989.

*Primary Examiner*—Richard R. Cole
*Attorney, Agent, or Firm*—Leydig, Voit & Mayer

[57] ABSTRACT

A luminary comprises a sack, a candle, a heavy block disposed in the bottom of the sack to keep the sack from blowing over and to hold the candle in an upright position, and wires attached to the block to keep the panels of the sack from blowing inwardly against the candle.

1 Claim, 2 Drawing Sheets

LUMINARY

BACKGROUND OF THE INVENTION

This invention relates to a nighttime outdoor display unit and, more particularly, to a luminary which is placed on a sidewalk, a driveway or the like for Christmas or other festive occasions to create a decorative outside display.

Typically, a luminary consists of a sack with a quantity of sand in its bottom to weight the sack down and to hold a candle in an upright position. When the candle is lit, its flame causes the sack to glow. Holes may be punched in a predetermined pattern through the panels of the sack to create the appearance of a Christmas tree, a Santa Claus, etc.

Many people find it difficult to obtain sand for use in a luminary. Also, sand is a messy material with which to work. Under even moderate wind conditions, the panels of a sack weighted with sand can blow into the candle and catch fire.

SUMMARY OF THE INVENTION

The aim of the present invention is to provide a new and improved luminary in which the sack is weighted without the use of sand or similar messy materials, which holds the candle in a stable position in the sack, and which prevents the panels of the sack from being blown inwardly against the candle.

DETAILED DESCRIPTION OF THE PREFERRED EMBODIMENT

Figure 1:
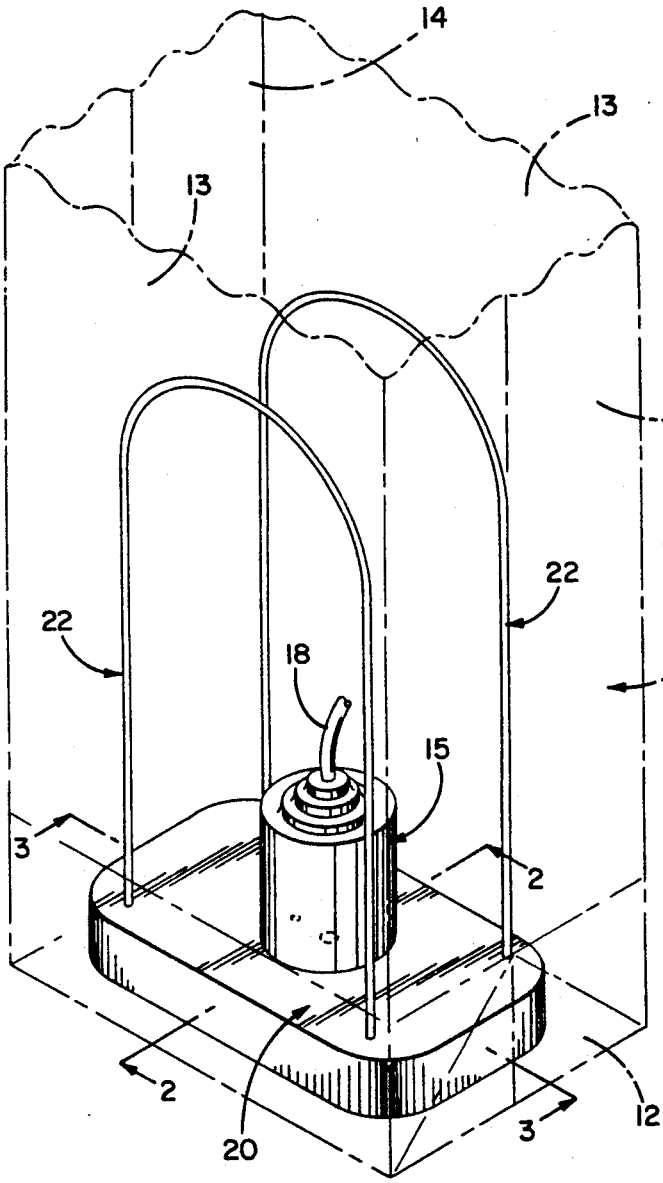
FIG. 1 is a perspective view of a new and improved luminary incorporating the unique features of the present invention, the sack of the luminary being shown in phantom.

As shown in the drawings for purposes of illustration, the invention is embodied in a luminary 10 of the type which is used to create a nighttime outdoor display during Christmas, Halloween or the like. Conventionally, a luminary comprises a sack 11 having an open top, a flat and generally rectangular bottom wall 12, generally parallel front and rear panels 13 upstanding from the bottom wall, and two side panels 14 extending between the front and rear panels and also upstanding from the bottom wall. The side panels 14 usually are gusset panels adapted to fold in between the front and rear panels 13 when the sack is flattened while the bottom wall 12 is adapted to fold upwardly against one of the latter panels during flattening of the sack.

Figure 2:
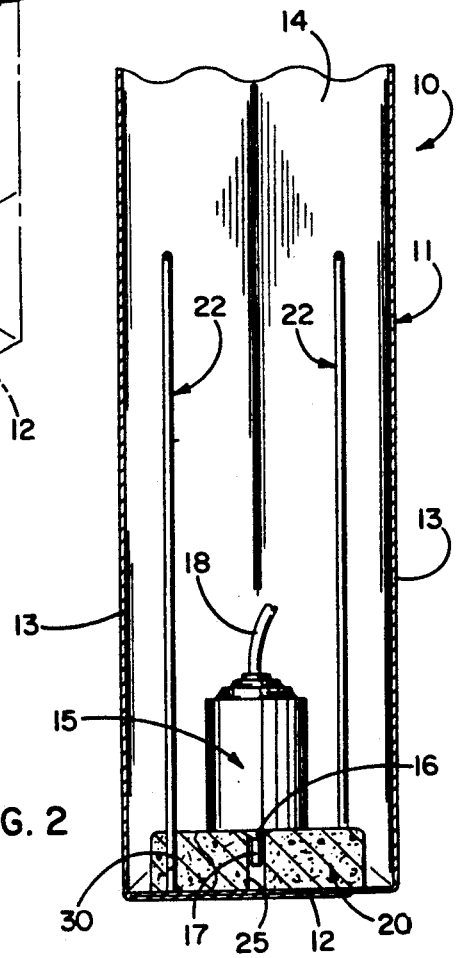
FIGS. 2 and 3 are fragmentary cross-sections taken substantially along the lines 2—2 and 3—3, respectively, of FIG. 1.
Figure 3:
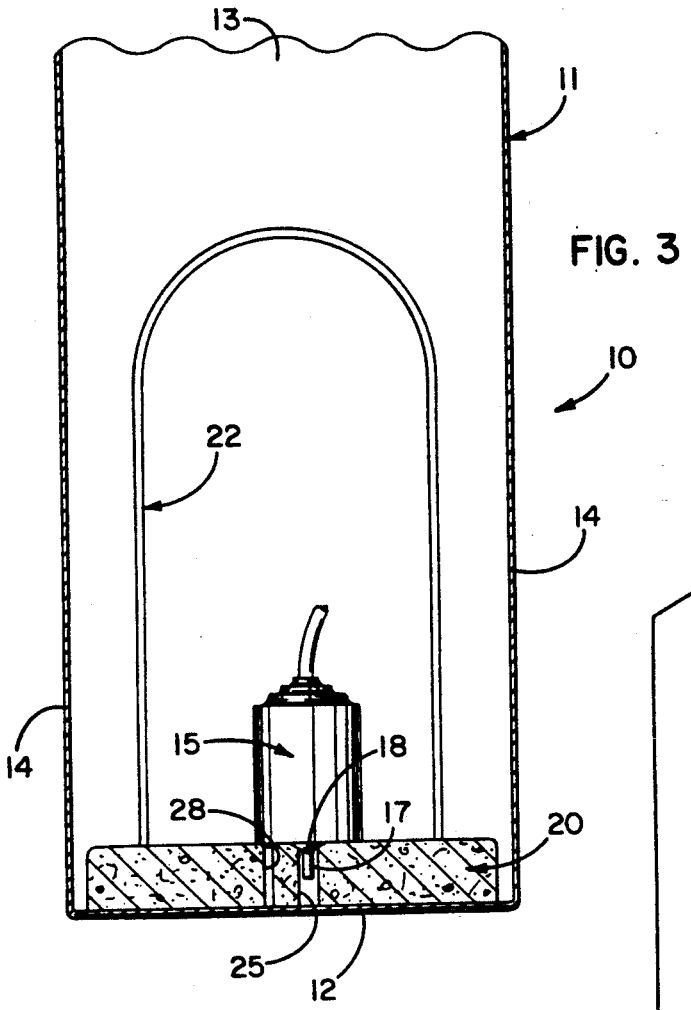

The luminary 10 also comprises a candle 15 adapted to be placed near the bottom 12 of the sack 11 and adapted to be lit to cause the sack to glow. Herein, the candle has been shown in FIGS. 1-3 as being a rather squat votive candle whose bottom includes a metal plate with a short downwardly extending projection 16 (FIG. 2). A portion 17 of the wick 18 of the candle extends downwardly from the projection.

In accordance with the present invention, the luminary 10 is provided with a base 20 which fits into the bottom 12 of the sack 10 and which basically performs three functions. That is, the base weights down the sack to keep the sack in an upright position, it holds the candle 15 approximately in the center of the sack, and it supports two wires 22 which keep the panels 13, 14 of the sack from blowing inwardly against the candle.

In the present instance, the base 20 is a generally rectangular block which may be cast from concrete or other dense and relatively inexpensive material. Alternatively, the base may be a block of wood. The rectangular dimensions of the block 20 are approximately ¼" less than the rectangular dimensions of the bottom 12 of the sack so that the block fits closely within the sack but can be easily inserted into and removed from the sack. When the block is placed in the sack, its substantial weight prevents the sack from blowing over from an upright position.

Figure 4:
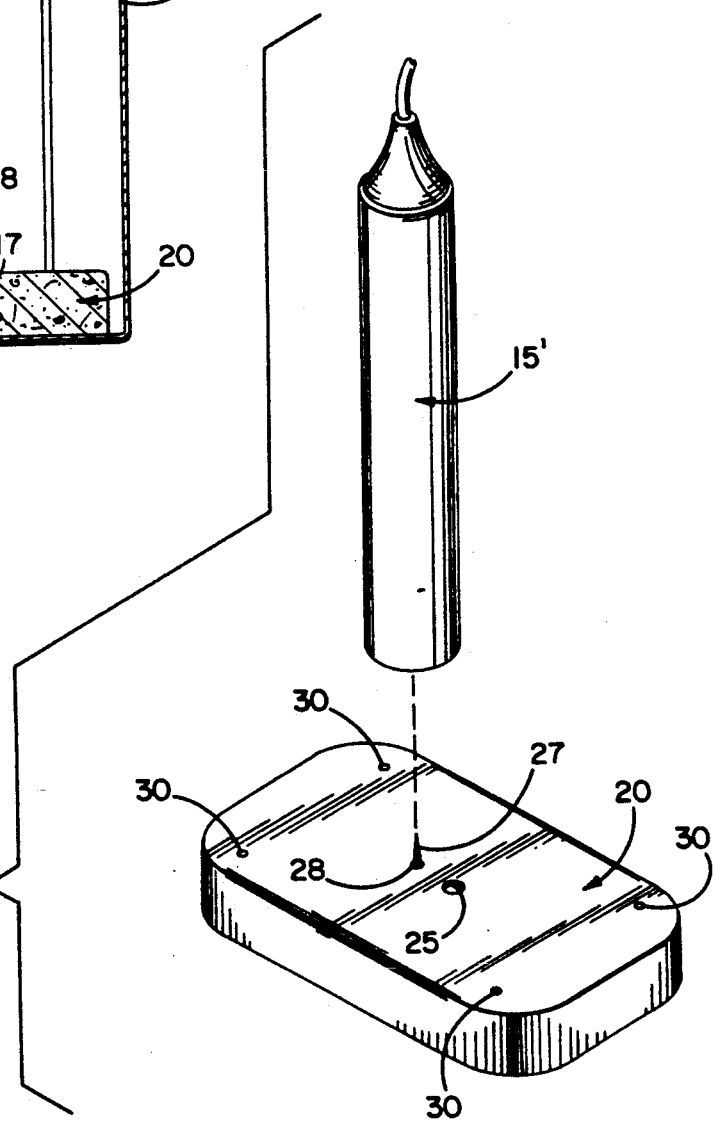
FIG. 4 is an exploded view showing the block of the luminary and showing another type of candle adapted to be supported by the block.

Formed in the central portion of the upper side of the block 25 (FIGS. 2-4) is a hole 25 which is adapted to receive the downwardly extending projection 16 of the candle 15 along with the lower end portion 17 of the wick 18. By virtue of the projection and the lower wick portion seating in the hole, the candle is held in a substantially centered position on the block. If a longer candle is used, such as the candle 15' shown in FIG. 4, a toothpick 27 may be broken in half and placed in a smaller hole 28 (FIGS. 3 and 4) formed in the block adjacent the hole 25. The long candle then may be stuck onto and held in place by the toothpick. If desired, a broken toothpick in the hole 28 also may be used with the squat votive candle to provide a more secure holding action.

Upwardly opening holes 30 (FIGS. 2 and 5) are formed in the corner portions of the block 20. The holes are adapted to receive the end portions of the wires 22. Each wire is generally of an inverted U-shaped configuration and has a height just somewhat less than the height of the sack 11. Each wire is assembled to the block by pushing the two end portions of the wire into the two holes adjacent the longer side of the block.

When the block 20 with the assembled wires 22 is placed into the sack 11, the wires are disposed in opposing relation with the front and rear panels 13 of the sack. Thus, the wires keep those panels from being blown inwardly against the candle 15 and reduce the danger of the sack catching on fire. The wires also tend to prevent the gusseted side panels 14 from collapsing inwardly.

The candle 15 and the wires 22 may be assembled with the block 20 while the block is outside the sack 11. The two wires then may be squeezed together at their upper ends to cause the lower end portions of the wires to frictionally engage the walls of the holes 30. This enables the entire assembly to be lowered into the sack. Also, the assembly can be lifted from the sack in the same way for purposes of re-lighting the candle.

The various components of the luminary 10 can be quickly and easily assembled from inside the home and without use of messy sand. Also, the components may be easily disassembled and compactly stored.

I claim:

1. A luminary comprising a one-piece and upright flexible sack having an open top, having a generally rectangular bottom wall, having a pair of generally parallel front and rear panels upstanding from said bottom wall, and having a pair of opposing side panels upstanding from said bottom wall and extending between said front and rear panels, a generally rectangular block of substantial weight disposed in said sack and resting on the bottom wall thereof to hold said sack in an upright position, said block having an upper side with a center portion and with four corner portions, a candle having a lower end, means in the center portion of the upper side of said block and engageable with the lower end of said candle to hold the candle in an upright position in said sack, an upwardly opening hole formed in the upper side of said base adjacent each of said corner portions, a pair of wires, each wire being of generally inverted U-shaped configuration and having two end portions, the end portions of one of said wires being received in two adjacent ones of said holes, the end portions of the other of said wires being received in the other two of said holes, said wires being disposed in upright positions and holding the panels of said sack away from said candle and the flame produced thereby when the candle is lit.

* * * * *